United States Patent [19]

Denier et al.

[11] Patent Number: 4,744,375

[45] Date of Patent: May 17, 1988

[54] PROCESS FOR FORMING FLAVOR COMPOUNDS IN TOBACCO

[75] Inventors: Robert F. Denier; Elmer F. Litzinger; Ezra D. Allford, all of Louisville, Ky.

[73] Assignee: Brown & Williamson Tobacco Corporation, Louisville, Ky.

[21] Appl. No.: 832,551

[22] Filed: Feb. 24, 1986

[51] Int. Cl.[4] ..... A24B 15/28; A24B 3/12

[52] U.S. Cl. ..... 131/309; 131/300; 131/301; 131/302; 131/303; 131/276

[58] Field of Search ..... 131/309, 310, 290, 297, 131/300, 301, 302, 303, 276

[56] References Cited

U.S. PATENT DOCUMENTS 4,607,646 8/1986 Lilly et al. ..... 131/276

4,638,816 1/1987 Cox ..... 131/276

*Primary Examiner*—V. Millin

*Attorney, Agent, or Firm*—Charles G. Lamb

[57] ABSTRACT

A tobacco treating process for forming favorable flavor compounds in a moisturized tobacco including the steps of introducing the moistened tobacco into a containing zone; introducing an ammonia source into the containing zone; heating the contained zone when substantially closed to bring the tobacco to a preselected temperature to improve flavor compounds through reaction of the ammonia source and reducing sugars, and/or other tobacco components; and cooling and removing the tobacco from the closed zone.

29 Claims, 3 Drawing Sheets

PROCESS FOR FORMING FLAVOR COMPOUNDS IN TOBACCO

BACKGROUND OF THE INVENTION (1) Field of the Invention

The invention relates to tobacco treating processes and more particularly to a process of forming favorable flavor compounds in a moisturized tobacco.

(2) Description of the Prior Art

It is generally well known in the tobacco processing art to use an alkali and steam as a means of removing nicotine from tobacco. For example, long expired U.S. Pat. No. 896,124, issued to G. B. Lindenberger, et al, on Aug. 18, 1908, teaches applying a caustic soda to tobacco stems or stalks and passing steam successively through flow through chambers containing the tobacco at temperatures of 250° F. to 300° F. to extract nicotine and other volatile constituents from the tobacco. Long expired U.S. Pat. No. 999,674, issued to J. Sartig on Aug. 1, 1911, teaches treating tobacco with ammonia for liberating nicotine and then passing steam below 212° F. continuously through the tobacco to carry off nicotine with the steam. U.S. Pat. No. 1,671,259, issued to T. Schloesing on May 28, 1928, teaches circulating a mixture of steam and ammonia through tobacco at temperatures below 212° F. to remove nicotine. U.S. Pat. No. 1,880,336, issued to A. Wenusch on Oct. 4, 1932, teaches passing heated air through tobacco until the tobacco reaches 212° F. and then passing superheated steam therethrough to reduce the nicotine in the tobacco. U.S. Pat. No. 1,984,445, issued to W. Wagner on Dec. 18, 1934, teaches removing nicotine from tobacco by passing an ammonia vapor through the tobacco, aerating the tobacco and then exposing the tobacco to acetic acid while subjecting the tobacco to an evaporation heat. U.S. Pat. No. 2,136,485, issued to F. Berka et al, on Nov. 15, 1938, teaches denicotizing tobacco by passing a mixture of air and ammonia therethrough at temperatures below 212° F. U.S. Pat. No. 4,153,063, issued to W. Roselius et al, on May 8, 1979, teaches denicotizing tobacco by passing carbon dioxide therethrough at very high pressure ranges and temperatures below 212° F.

A number of other patents, such as U.S. Pat. Nos. 1,671,259, issued to T. Schloesing on May 29, 1928; 3,151,118, issued to G. P. Moser on Sept. 29, 1964; 3,742,962, issued to C. Brochot on July 3, 1973; and 3,821,960, issued to L. Egri on July 2, 1974, teach or suggest the broad use of an ammonia source and steam at comparatively low temperature ranges below 250° F. for the purpose of denicotizing tobacco. Further, U.S. Pat. No. 3,760,815 issued to E. J. Deszyck on Sept. 25, 1973, teaches the use of an ammonia source and salts for the purpose of tobacco coherence. In addition, U.S. Pat. Nos. 3,771,533, issued to R. G. Armstrong et al on Nov. 17, 1973; 4,248,252, issued to A. T. Lendvay et al on Feb. 3, 1981; and 4,266,562, issued to H. B. Merritt et al on May 12, 1981, all suggest use of an ammonia source and $CO_2$ some even at temperatures in excess of 250° F. for purposes of puffing or expanding tobacco. In fact, flavor has been a consideration in utilizing an ammonia source for flavor enhancement of a synthetic material in U.S. Pat. Nos. 4,079,742, issued to N. B. Ranier et al on Mar. 21, 1978 and 4,184,495, issued to N. B. Ranier et al on Jan. 22, 1980 and in utilizing an ammonia source with a carboxylic acid as taught by U.S. Pat. No. 4,286,606, issued to J. W. Swain et al. on Sept. 1, 1981. However, none of these aforenoted patents teaches or suggests the novel process of utilizing an ammonia source and steam in the manner as specifically set forth herein for forming favorable flavor compounds in a moisturized tobacco.

In the main, the past tobacco treating art has either utilized an ammonia source and steam in treating tobacco materials, the processes generally employing continuous flow through systems for the purpose of extracting nicotine from the treated tobacco or expanding the tobacco; or, the past art has utilized an ammonia source and a specifically selected organic compound when flavor has been a consideration.

In accordance with the present invention, an improved, straightforward, efficient and economical tobacco treating process is provided. The present invention recognizes the benefits, efficiency, economy and utility of treating tobacco with steam and an ammonia source, and employs these treating agents in a novel and useful manner to obtain an improved tobacco product for smoking articles, such as cigarettes, which has enhanced flavor qualities heretofore unknown in tobacco smoking articles without sacrifice of other essential and desirable tobacco product qualities or harm to the moisture qualities thereof.

Various other features of the present invention will become obvious to one skilled in the art upon reading the novel disclosure set forth herein.

SUMMARY OF THE INVENTION

More particularly, the present invention provides a tobacco treating process for forming flavor compounds in a moisturized tobacco including: introducing moisturized tobacco to be treated into a tobacco containing zone; introducing an ammonia source into the contained zone; heating the contained zone when substantially closed to bring the tobacco to a temperature in the range of approximately 250° F. to 350° F. for a sufficient time period to cause reaction of the ammonia source and reducing sugars to improve tobacco flavor compounds without substantially reducing tobacco moisture content, cooling the tobacco in the containing zone; and, removing the tobacco from the zone when cooled to a preselected level.

It is to be understood that various changes can be made by one skilled in the art in one or more of the several steps of the inventive method disclosed herein without departing from the scope or spirit of the present invention.

BRIEF DESCRIPTION OF THE DRAWINGS

Referring to the drawings which disclose one advantageous embodiment of the present invention.

DETAILED DESCRIPTION OF THE INVENTION

Figure 1:
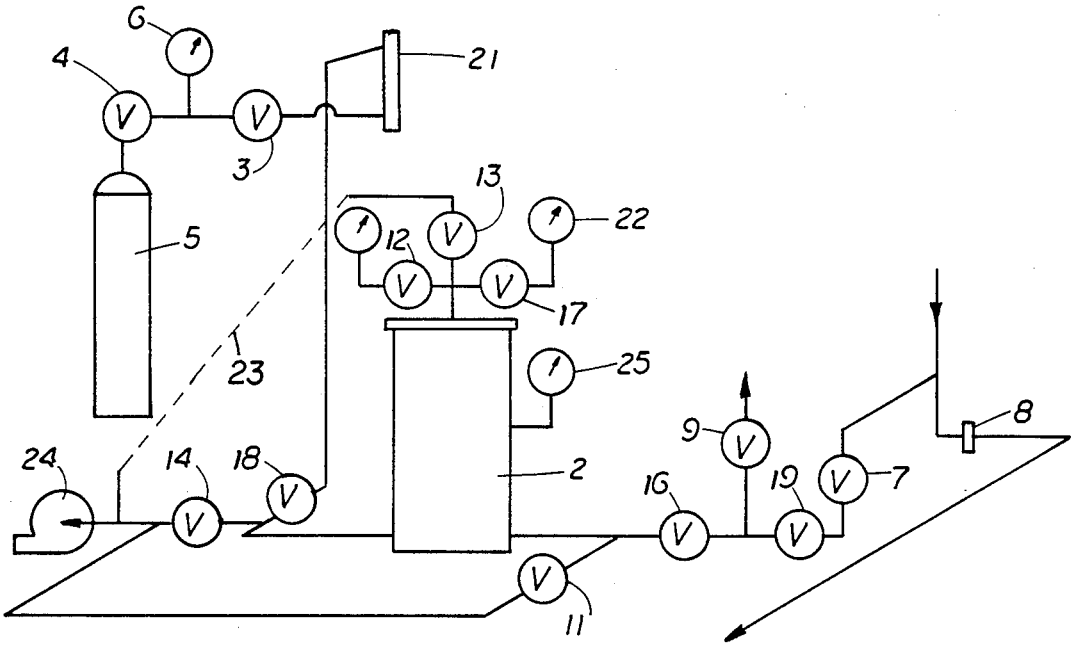
FIG. 1 is a schematic flow diagram of apparatus which can be used in carrying out the inventive process, utilizing wet heat.

Referring to FIG. 1 which discloses the embodiment of the inventive process utilizing a suitable ammonia source and wet heat, tobacco to be treated advantageously in the moisture content by weight range of 10% to 60% is placed into a foraminous screen type flow through basket (not shown). The basket is then placed into impregnator 2 and the lid thereof sealed to prevent leakage. With valve 3 closed, primary ammonia gas valve 4 is opened. A pressure of approximately 120–130 psig is read on pressure gauge 6 indicating availability of ammonia gas. Primary steam valve 7 is opened to allow live steam at 120 psig, which can be superheated, to be available for impregnation. It is to be noted that steam trap 8 removes unwanted condensate from the steam line so that the condensate does not flow into impregnator 2.

With valves 9, (which leads to a 15" Hg vacuum) 11, 12, 13 and 14 closed, valves 16 and 17 are opened. It is to be noted that valve 18 serves as a check valve to prevent backflow of gases into ammonia tank 5. Simultaneously, valves 3 and 19 are opened to allow ammonia gas and steam to flow respectively through these valves into otherwise closed impregnator 2 containing the screen basket of tobacco to be treated, the flow of ammonia gas being indicated by rotometer 21. The flow of both gases into impregnator 2 is allowed to continue until the desired pressure in the range of 30–90 psig and advantageously 60 psig as indicated by pressure gauge 22 and the desired temperature of the tobacco in the range of 250°–350° F., preferably in the range of 280° F. to 320° F., and advantageously 308° F. as indicated by temperature gauge 25 are reached.

When the desired pressure and tobacco temperature have been reached and the tobacco has been treated for a preselected residence time in the range of 5 minutes to 24 hours, valves 3 and 19 are closed and valves 14 and 13 are opened to allow residual gas to flow out of impregnator 2 as the pressure within the impregnator returns to atmospheric and the tobacco cooled by natural convection. In this regard, it is to be noted that line 23 connects both exhaust points through valves 14 and 13 to a common exhaust blower 24 which assists in the depressurization step. After depressurization, vacuum valve 9 is open and the lid to impregnator 2 is removed. The tobacco is then removed from the screen basket and dryed or reordered, as the case may be to a final moisture content suitable for smoking article manufacture, advantageously in the range of 12% to 15% by weight. It is to be understood that in accordance with the present invention, the tobacco to be treated can be subjected to at least 15 inches of mercury vacuum by opening vacuum valve 9 for a period prior to introduction of an ammonia source into the closed zone. It is further to be understood that the ammonia source for treating the tobacco can be in the form of ammonium hydroxide introduced into impregnator 2 as a liquid. Further, it is to be understood, that introduction of steam and an ammonia source need not be simultaneous but can be sequential as well. As to the tobacco to be treated, it can be in any one of several forms, such as stem, leaf, reconstituted or a mixture of the same. Further, cooling of the treated tobacco, in addition to release of gas pressure and natural convection can also be accomplished conductively through suitable mechanical cooling equipment (not shown). Moreover, it is to be understood that, in view of the variations of the amounts of inherent reducing sugars in tobaccos to be treated, additional reducing sugars can be added prior to heating.

Figure 2:
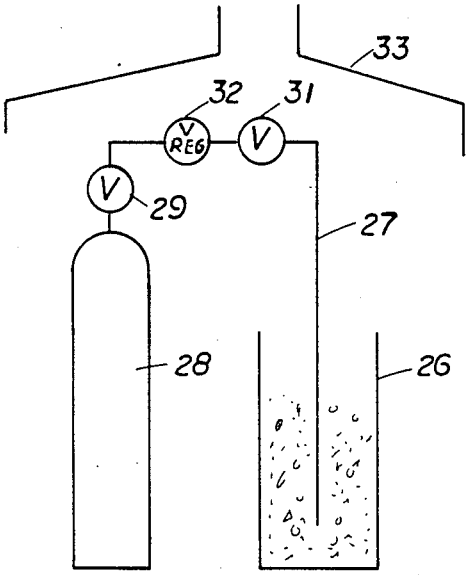
FIG. 2 is a schematic flow diagram of apparatus which can be used in carrying out the inventive process, utilizing dry heat.
Figure 3:
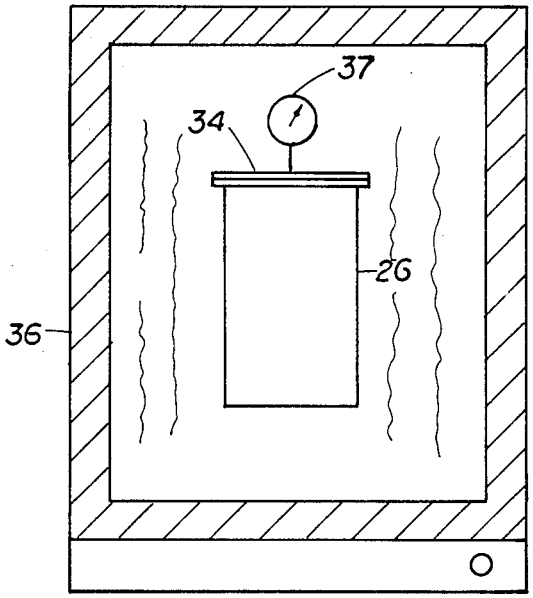
FIG. 3 is a schematic arrangement of a convection oven with a tobacco impregnator disposed therein which can be used in accordance with the process of FIG. 2, utilizing dry heat.
Figure 4:
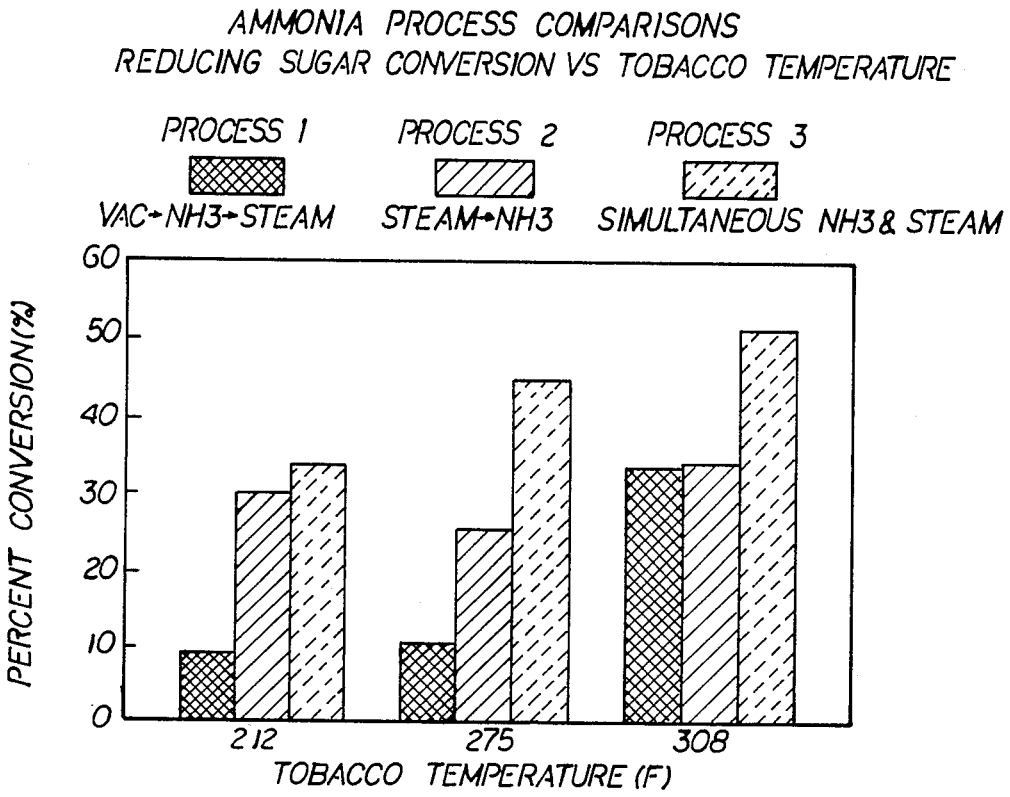
FIG. 4 is a bar graph comparing three variations of the inventive process, plotting reducing sugar conversion against tobacco temperature for three different temperatures.
Figure 5:
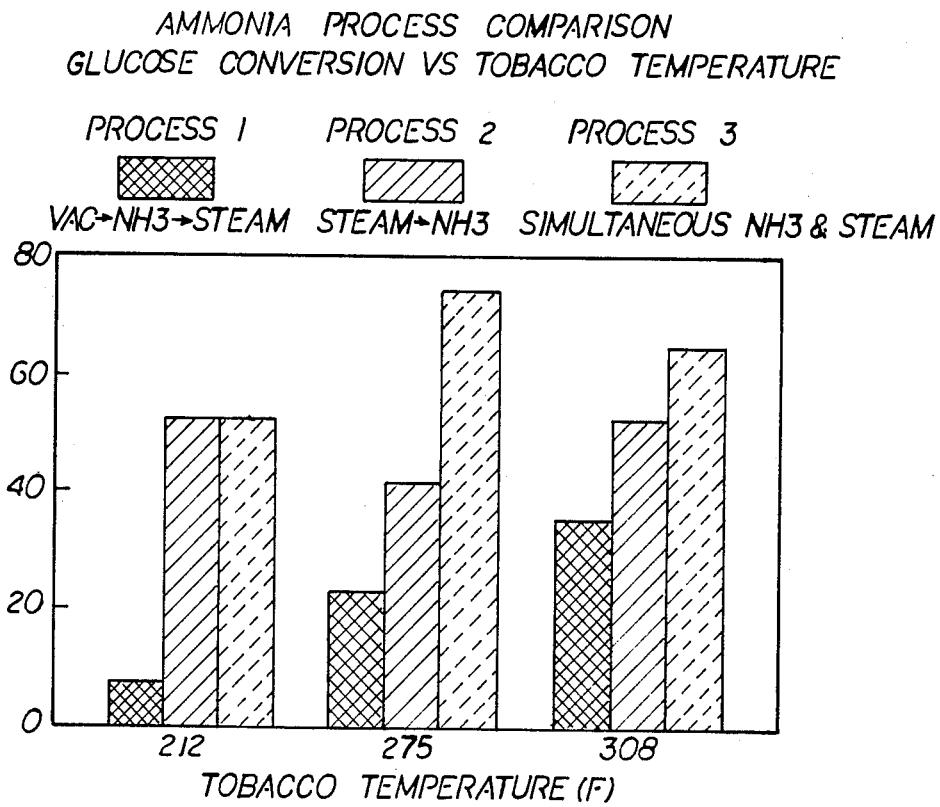
FIG. 5 is a bar graph comparing the same three variations of the inventive process, plotting glucose conversion against tobacco temperature for the same three different temperatures of FIG. 4.
Figure 6:
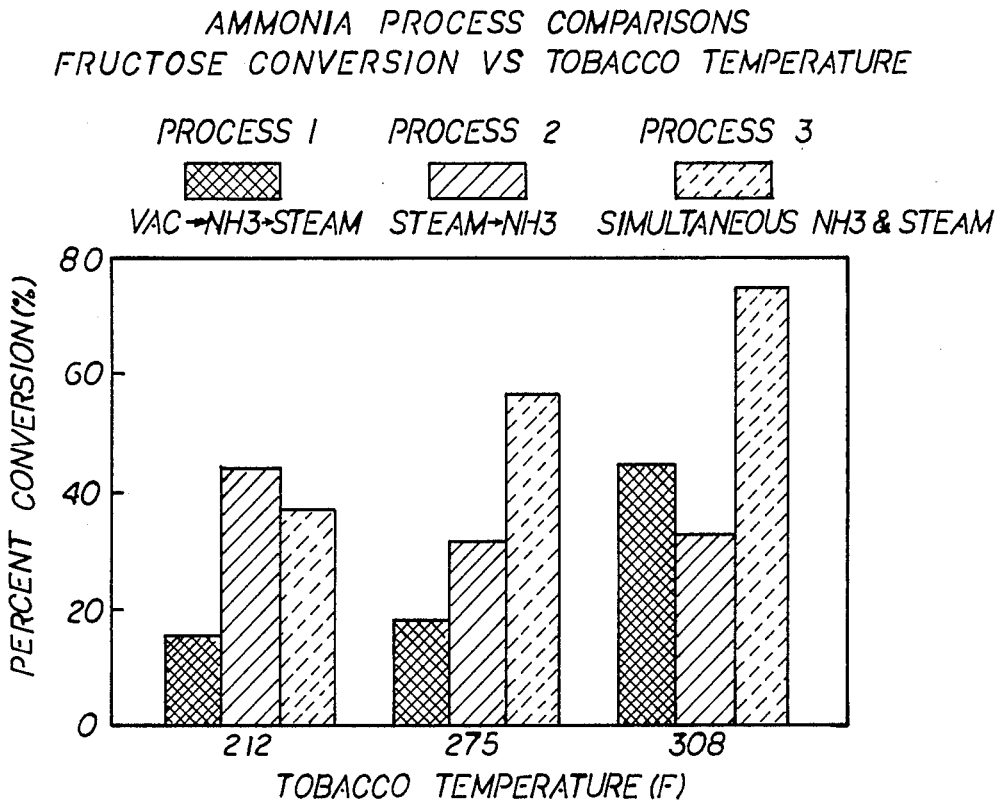
FIG. 6 is a bar graph comparing the same three variations of the inventive process, plotting fructose conversion against tobacco temperature for the same three different temperatures of FIG. 4; and, FIG. 7 is a bar graph comparing low temperature and high temperature variations of the inventive process utilizing ammonia and steam simultaneously, plotting pyrazine control ratio for seven types of pyrazines.
Figure 7:
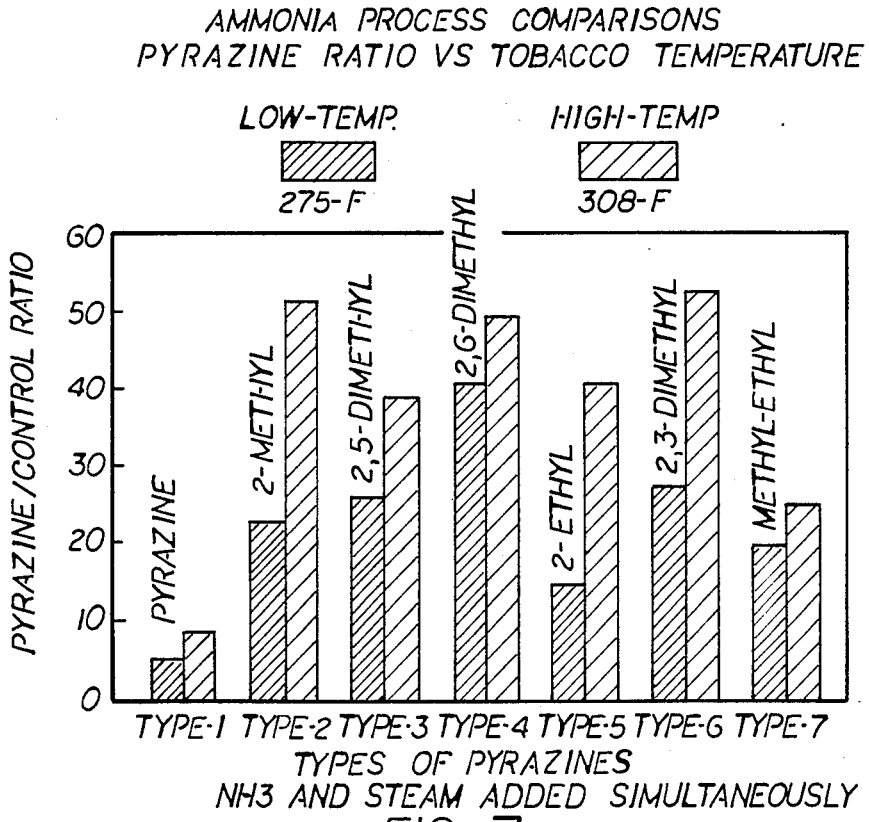

Referring to FIGS. 2 and 3 which disclose a further embodiment of the inventive process utilizing a suitable ammonia source and dry heat, tobacco to be treated which can be in any one of the several forms aforedescribed with a percentage by weight moisture content as aforedescribed is placed into a to be closed impregnator 26. A conduit 27 is then inserted into the center of the tobacco bed. The conduit 27 is connected to a suitable ammonia source which is disclosed as an ammonia gas through valves 29 and 31 and regulator 32. With valve 31 closed, primary valve 29 is opened and regulator 32 is set at approximately 10–20 psig delivery pressure for ammonia gas. Valve 31 is then opened to allow the ammonia gas to flow through pipe 27 into the bed of tobacco in impregnator 26. The gas flow is allowed to continue until the air directly above the tobacco bed is saturated with ammonia. A suitable pH indicator, such as litmus paper, can be used to determine pH change with ammonia fumes being removed from the system through exhaust hood 33. It is to be understood that the tobacco to be processed can also be pretreated prior to placing into the impregnator and the ammonia gas step eliminated.

When ammonia saturation of the tobacco to be treated has been reached, valve 31 is closed, pipe or conduit 27 removed and lid 34 securely fastened at the top of impregnator 26 to prevent leakage. Impregnator 26 is then placed in convection oven 36 (FIG. 3) and heat is applied for 30 to 90 minutes to raise the tobacco to a temperature in the range of 250° to 350° F. After a suitable residence time, such as aforedescribed, the impregnator 26 is removed from the oven and cooled, either by natural convection or by suitable mechanical cooling means. It is to be noted that temperature gauge 37 permits reading of tobacco temperature. When the temperature of the tobacco reaches ambient, lid 34 is removed and the tobacco removed form the impregnator for further treatment as aforedescribed.

Set forth herein below are several examples and resulting tables for each example of various tobaccos treated in accordance with the inventive process and variations thereof described herein, using either the equipment of FIG. 1 or that of FIGS. 2 and 3.

EXAMPLE 1

One pound of a single flue-cured grade of cut lamina tobacco at a moisture content of 21% by weight was placed in a screen basket and inserted in an impregnator such as in the apparatus schematically disclosed in FIG. 1. Fifteen inches of mercury (Hg) vacuum was drawn on the tobacco in the impregnator to remove air therefrom, after which ammonia ($NH_3$) gas under pressure was introduced into the impregnator from the ammonia tank, approximately 0.128 pounds of ammonia gas being utilized as indicated on the flow rotometer 21, until pressure within the impregnator returned to atmospheric. A zero psig condition as reflected in Tests 1 and 4 of Table 1 below was obtained by allowing all exhaust valves from the impregnator to remain open during subsequent steam addition to the impregnator. Pressures of 30 and 60 psig as reflected in Tests 2, 5 and 3, 6 respectively were obtained by closing the exhaust valves from the impregnator while steam was being injected, resulting in a rise in pressure within the impregnator. It is to be noted from Table 1 that such rises in pressure resulted in concomitant tobacco temperatures in the impregnator of 275° F. and 308° F. respectively. Thus, the final system pressures of 0, 30 and 60 psig in Table 1 correspond to tobacco temperatures of 212° F., 275° F. and 308° F. To permit reaction time of ammonia and steam, the indicated pressures were held for 5 minutes in Tests 1, 2 and 3 and for 30 minutes in Tests 4, 5 and 6. All samples of Table 1 below are shown as compared to an untreated control sample which was conditioned to equilibrium moisture in a 60% relative humidity, 75° F. atmosphere. All treated samples were dryed to a final moisture target of 14% by weight in a conventional pneumatic dryer. It was found that smoking articles treated at 308° F. (Tests 3 and 6), notwithstanding presence of some impact and irritation, had more flavor than the control sample with the more than compensating flavor compounds such as pyrazines being enhanced by the reaction of the ammonia and reducing sugars at the indicated pressures and temperatures.

TABLE 1

| | Control | Test 1 | Test 2 | Test 3 | Test 4 | Test 5 | Test 6 |
|---|---|---|---|---|---|---|---|
| Tobacco Temperatures (°F.) | — | 212 | 275 | 308 | 212 | 275 | 308 |
| Reaction Time (Minutes) | — | 5 | 5 | 5 | 30 | 30 | 30 |
| Reducing Sugars (%) | 12.3 | 13.4 | 11.0 | 8.3 | 9.8 | 6.1 | 3.3 |
| Glucose (%) | 2.8 | 3.0 | 2.2 | 1.8 | 2.0 | 1.0 | 0.4 |
| Fructose (%) | 4.4 | 5.1 | 3.6 | 2.4 | 0.3 | 1.4 | 0.5 |
| Ammonia Content (%) | .04 | .33 | 0.06 | 0.36 | 0.33 | 0.62 | 0.63 |
| System Pressure (psig) | — | 0 | 30 | 60 | 0 | 30 | 60 |

EXAMPLE 2

A one pound sample of the same tobacco as in Example 1 was treated using the wet type apparatus of FIG. 1. Two processes were evaluated at each of the three tobacco temperatures and pressures of Example 1 namely, 212° F., 275° F. and 308° F. with concomitant respective pressures of 0, 30 and 60 psig. Process A of Tests 1, 2 and 3 in Table 2 below followed the sequence of steam first and then an ammonia source. Process B of Tests 4, 5 and 6 added the steam and ammonia source simultaneously. In process A, saturated steam was injected into the impregnator up to a pressure 5 psig below final pressure before discontinuance. Ammonia gas was introduced into the impregnator until final system pressure was obtained. As can again be noted, at the final system pressure for each test, the tobacco temperature is equivalent to the adiabatic saturation temperature of the steam; namely 0 psig=212° F., 30 psig=275° F., and 60 psig=308° F. In process B involving the simultaneous addition of steam and an ammonia source until final pressure was reached, the ammonia gas flow was maintained constant using flow readings from the ammonia rotometer 21. As in Tests 1, 2 and 3 of Example 1, the reaction time for all tests, namely Tests 1-6 was 5 minutes. Expert smokers found the sample treated at a tobacco temperature of 308° F. (60 psig) to have more flavor providing a better balance as to impact and irritation over a control sample not treated with an ammonia source. As can be observed in Table 2 herein below and from the graphs of FIGS. 4-7, more advantageous results are obtained in a process involving the simultaneous addition of steam and ammonia with impregnator pressures and temperatures at 60 psig and 308° F. respectively.

TABLE 2

| | Control | Test 1 | Test 2 | Test 3 | Test 4 | Test 5 | Test 6 |
|---|---|---|---|---|---|---|---|
| Process Sequence | — | A | A | A | B | B | B |
| Tobacco Temperatures (°F.) | — | 212 | 275 | 308 | 212 | 275 | 308 |
| Reducing sugars (%) | 13.7 | 9.6 | 10.1 | 9.2 | 9.1 | 7.4 | 6.7 |
| Glucose (%) | 2.7 | 1.3 | 1.6 | 1.3 | 1.3 | 0.7 | 1.0 |
| Fructose (%) | 5.2 | 3.0 | 3.5 | 3.5 | 3.4 | 2.4 | 1.3 |
| Tobacco pH | 5.5 | 5.5 | 5.3 | 5.4 | 5.7 | 6.0 | 6.5 |
| Ammonia content (%) | 0.05 | 0.11 | 0.07 | 0.09 | 0.22 | 0.23 | 0.17 |
| Flavor compounds (Ratio to Control) | | | | | | | |
| Pyrazines | — | — | — | — | — | 4.7 | 7.7 |
| 2-Methyl pyrazine | — | — | — | — | — | 22 | 50 |
| 2,5-Dimethyl pyrazine | — | — | — | — | — | 25 | 37 |
| 2,6-Dimethyl pyrazine | — | — | — | — | — | 40 | 49 |
| 2-Ethyl pyrazine | — | — | — | — | — | 14 | 40 |
| 2,3-Dimethyl pyrazine | — | — | — | — | — | 27 | 51 |
| Methylethyl pyrazine | — | — | — | — | — | 20 | 24 |

EXAMPLE 3

Two pounds of a cut flue-cured stem product having an initial moisture content in the range of approximately 55% to 60% was placed in an impregnator such as disclosed in FIG. 1 and processed accordingly at temperatures of 212° F., 275° F. and 308° F. After simultaneous ammonia and steam treatment, samples were conventionally dryed and then conditioned to equilibrium moisture in a humidity room at 60% relative humidity and 75° F. temperature. Cigarettes were made from the treated and control tobaccos. A 12% inclusion level of stem (treated or control) into a conventional lamina blend was used in the evaluation. Smokers found that cigarettes containing 12% of stem treated at 308° F. (60 psig) had less impact, irritation and aftertaste than a control containing untreated stem. Samples containing the treated tobacco were preferred. All 3 tests in the Table were treated at a 5 minute reaction time.

TABLE 3

| | Control | Test 1 | Test 2 | Test 3 |
|---|---|---|---|---|
| Tobacco temperature (°F.) | — | 212 | 275 | 308 |
| Reducing sugars (%) | 9.3 | 7.3 | 7.7 | 6.3 |
| Glucose (%) | 1.8 | 1.3 | 1.7 | 1.1 |
| Fructose (%) | 5.4 | 3.0 | 2.8 | 2.0 |
| Ammonia content (%) | 0 | 0.33 | 0.48 | 0.37 |
| Tobacco pH | 5.0 | 5.5 | 5.5 | 5.5 |

EXAMPLE 4

In this example, three types of tobacco in 350 gram amounts with moisture contents in the range of 10% to 14% were treated in a process utilizing dry heat in apparatus like that disclosed in FIGS. 2 and 3. The three types of tobacco represented by Tests 1, 2 and 3 respectively in Table 4 below included reconstituted tobacco, conventional flue-cured/Oriental lamina blend and a cut burley stem product. Ammonia gas was bubbled through impregnators containing each type of tobacco for periods of 5 minutes. Each impregnator was then sealed with a lid and placed in a convection oven (36) for a 90 minute period at 302° F. The impregnator was then removed from the oven and allowed to cool for 6–8 hours. Tobaccos were then removed from the impregnators and each incorporated into a conventional lamina tobacco blend at levels between 10–20%. Smokers found each of the sample blends to have less irritation and more flavor than corresponding untreated control samples. No differences in impact or aftertaste were detected. All treated samples were preferred over the controls. Data for the three types of tobacco tested is shown in Table 4 in comparison to untreated control samples.

TABLE 4

| | Reconstituted | | Flue-cured/ Oriental lamina | | Burley Stem | |
|---|---|---|---|---|---|---|
| Tobacco Type | Control | Test 1 | Control | Test 2 | Control | Test 3 |
| Reducing sugars (%) | 5.9 | 1.5 | 11.5 | — | 1.3 | 1.3 |
| Ammonia content (%) | 0.61 | 0.42 | .04 | — | .18 | .46 |
| Tobacco pH | 5.9 | — | 5.11 | — | 6.5 | 7.4 |
| Flavor compounds (Ratio to Control) | | | | | | |
| Pyrazine | — | 14 | — | 153 | — | 20 |
| 2-methyl pyrazine | — | 0.3 | — | 363 | — | 18 |
| 2,5-dimethyl pyrazine | — | 5 | — | 96 | — | 15 |
| 2,6-dimethyl pyrazine | — | 5 | — | 33 | — | 5 |
| 2-ethyl pyrazine | — | 57 | — | 5965 | — | 49 |
| 2,3-dimethyl pyrazine | — | 413 | — | 158 | — | 28 |
| methylethyl pyrazine | — | 77 | — | 59 | — | 30 |

EXAMPLE 5

One pound samples of a conventional lamina tobacco blend containing flue-cured, Oriental, burley and reconstituted tobacco were placed in the screen basket of an impregnator of an apparatus as disclosed in FIG. 1, utilizing wet heat. Steam and ammonia gas were injected into the impregnator simultaneously in Tests 1 and 2 until a final tobacco temperature of 308° F. and pressure of 60 psig was obtained. In Test 1, the reaction time of the steam and the ammonia source was for 5 minutes and in Test 2, the reaction time was allowed for 20 minutes before depressurization and tobacco removal. In Tests 3 and 4, similar one-pound samples of the same tobacco mixture were first sprayed with an ammonium hydroxide solution prior to insertion into an impregnator as in FIG. 1. Steam was then injected until a final tobacco temperature of 308° F. and pressure of 60 psig was obtained. In Test 3, the reaction time of the steam and the ammonia source was for 5 minutes and in Test 4 the reaction time was allowed for 20 minutes before depressurization and tobacco removal. The so treated tobacco samples each formed 20% of a conventional untreated lamina blend. Smokers found the blend with the 20 minute ammonia gas/steam sample of Test 2 to have less impact, less irritation and more flavor than a corresponding untreated control and highly preferred this blend over the control. Although samples of Tests 3 and 4 which included the ammonium hydroxide spray treatment show as much of an analytical difference from the control as the samples of Tests 1 and 2, only directional preference for the ammonium hydroxide samples over the control occurred.

TABLE 5

| | Control | Test 1 | Test 2 | Test 3 | Test 4 |
|---|---|---|---|---|---|
| Impregnation Media | None | $NH_3$gas/ Steam | $NH_3$gas/ Steam | $NH_4OH$/ Steam | $NH_4OH$/ Steam |
| Reaction time (min.) | — | 5 | 20 | 5 | 20 |
| Reducing sugars (%) | 8.0 | 6.1 | 3.7 | 5.4 | 3.7 |
| Glucose (%) | 1.8 | 1.9 | 1.8 | 1.3 | 1.8 |
| Fructose (%) | 2.4 | 1.4 | 0.4 | 1.1 | 0.3 |
| Ammonia content (%) | 0.15 | 0.34 | 0.52 | 0.17 | 0.83 |
| Tobacco pH | 5.2 | 5.8 | 5.9 | 5.5 | 5.6 |
| Flavor compounds (Ratio to Control) | | | | | |
| Pyrazines | — | 2 | 1 | 3 | 1 |
| 2-Methyl pyrazine | — | 4 | 3 | 6 | 2 |
| 2,5-Dimethyl pyrazine | — | 2 | 1 | 3 | 1 |
| 2,6-Dimethyl pyrazine | — | 2 | 2 | 3 | 2 |
| 2-Ethyl pyrazine | — | 2 | 9 | 3 | 3 |

TABLE 5-continued

| | Control | Test 1 | Test 2 | Test 3 | Test 4 |
|---|---|---|---|---|---|
| 2,3-Dimethyl pyrazine | — | 4 | 16 | 5 | 6 |
| Methylethyl pyrazine | — | 2 | 5 | 3 | 4 |

EXAMPLE 6

One pound samples of the lamina blend of tobaccos described in Example 5 were placed in the screen basket of an impregnator of an apparatus as disclosed in FIG. 1, utilizing wet heat. Ammonia gas and steam were simultaneously added to the impregnator for all tests until the tobacco temperature reached 308° F. and 60 psig for Tests 1 and 3 and 338° F. and 100 psig for Tests 2 and 4. The tobacco samples were held at these conditions for 20 minutes in Tests 1 and 2 and 60 minutes in Tests 3 and 4 before depressurization and removal. It is to be noted that for Tests 2 and 4, that the ammonia gas flow was discontinued when the tobacco samples each reached 308° F. with the steam flow continuing until a tobacco temperature of 338° F. and 100 psig pressure were obtained. The so treated tobacco samples each formed 10% and 20% of a conventional untreated lamina blend. Smokers found the cigarettes which included samples with higher reaction temperatures (Tests 2 and 4) to be less flavorful than those cigarettes which included samples with lower reaction temperatures (Tests 1 and 3).

TABLE 6

| | Control | Test 1 | Test 2 | Test 3 | Test 4 |
|---|---|---|---|---|---|
| Reaction temp (°F.) | — | 308 | 338 | 308 | 338 |
| Reaction pressure (psig) | — | 60 | 100 | 60 | 100 |
| Reaction time (min.) | — | 20 | 20 | 60 | 60 |
| Reducing sugars (%) | 9.2 | 2.9 | 2.6 | 2.3 | 2.3 |
| Glucose (%) | 1.9 | 1.0 | 1.0 | 0.9 | 0.9 |
| Fructose (%) | 3.0 | 0.0 | 0.0 | 0.0 | 0.0 |
| Ammonia content (%) | 0.17 | 0.46 | 0.41 | 0.38 | 0.26 |
| Tobacco pH | 5.4 | 6.0 | 5.8 | 5.9 | 5.8 |
| Flavor compounds (Ratio to Control) | | | | | |
| Pyrazine | — | 3 | 2 | 2 | 2 |
| 2-Methyl pyrazine | — | 15 | 5 | 15 | 5 |
| 2,5-Dimethyl pyrazine | — | 5 | 5 | 6 | 5 |
| 2,6-Dimethyl pyrazine | — | 4 | 3 | 6 | 6 |
| 2-Ethyl pyrazine | — | 19 | 4 | 24 | 3 |
| 2,3-Dimethyl pyrazine | — | 23 | 7 | 38 | 7 |
| Methylethyl pyrazine | — | 10 | 6 | 23 | 6 |

EXAMPLE 7

One pound samples of the same tobacco blend as used in Example 5, namely, a conventional tobacco blend containing flue-cured, Oriental, burley and reconstituted tobacco were placed in the screen basket of an impregnator of an apparatus as disclosed in FIG. 1, utilizing wet heat. Ammonia gas and saturated steam were simultaneously introduced into the impregnator until a temperature of 308° F. and a pressure of 60 psig were obtained. Reaction times of 20 minutes (Test 2 below) and 24 hours (Test 3 below) were examined and compared to the reaction time of 5 minutes used in Test 1 of Example 5 (Test 1 below). Only flavor compound analysis was performed because of the very high moisture and poor particle size obtained with the 24 hour sample.

TABLE 7

| | Control | Test 1 | Test 2 | Test 3 |
|---|---|---|---|---|
| Reaction time (minutes) | — | 5 | 20 | 1440 |
| Flavor compounds (Ratio to Control) | | | | |
| Pyrazine | | 2 | 1 | 182 |
| 2-Methyl pyrazine | — | 4 | 3 | 232 |
| 2,5-Dimethyl pyrazine | — | 2 | 1 | 71 |
| 2,6-Dimethyl pyrazine | — | 2 | 2 | 31 |
| 2-Ethyl pyrazine | — | 2 | 9 | 102 |
| 2,3-Dimethyl pyrazine | — | 4 | 16 | 352 |
| Methylethyl pyrazine | — | 2 | 5 | 132 |

EXAMPLE 8

Two 7-pound samples of a flue-cured stem product having a starting moisture of 14% were sprayed with water to a final moisture of 60%. A third sample of stem was also sprayed with water to a 60% level; however; a mixture or commercially available invert sugar was added to the spray water to increase the starting reducing sugar level from 8.4% to 18.7%. One sample of the "water only" sample was conventionally dried and acted as a "control." The other "water only" sample (Test 1) and the sample having reducing sugars added (Test 2) were treated in an apparatus such as disclosed in FIG. 1. Simultaneous addition of ammonia and steam to a final tobacco temperature of 308° F. and pressure of 60 psig for 20 minutes were the conditions used in Tests 2 and 3. As noted in Table 8, flavor compounds have been enhanced with the addition of more reducing sugars.

TABLE 8

| | Control | Test 2 | Test 3 |
|---|---|---|---|
| Starting reducing sugars (%) | 8.4 | 8.4 | 18.7 |
| Product reducing sugars (%) | 5.4 | 2.6 | 3.8 |
| Product glucose (%) | 2.36 | 2.62 | 2.04 |
| Product fructose (%) | 1.55 | 0.21 | 0.53 |
| Ammonia content (%) | 0.03 | 0.25 | 0.16 |
| Product pH | 5.1 | 5.8 | 5.7 |
| Flavor Compounds (Ratio to Control) | | | |
| Pyrazines | — | 3 | 5 |
| 2-Methyl Pyrazine | — | 10 | 21 |
| 2,5-Dimethyl Pyrazine | — | 9 | 9 |
| 2,6-Dimethyl Pyrazine | — | 4 | 7 |
| 2-Ethyl Pyrazine | — | 16 | 52 |
| 2,3-Dimethyl Pyrazine | — | 22 | 47 |
| Methylethyl Pyrazine | — | 8 | 18 |

It is to be understood that in the above tables the "Ratio to Control" is equivalent to test value divided by control value.

The invention claimed is:

1. A method of of forming favorable flavor compounds in a moisturized tobacco comprising: introducing the moisturized tobacco to be treated into a tobacco containing zone; introducing an ammonia source into said tobacco containing zone; heating said tobacco containing zone by injecting steam into said containing zone when substantially closed to bring the temperature of the tobacco introduced into said zone to a temperature in the range of approximately 250° F. to 350° F. for a sufficient time period to cause reaction of the ammonia source and reducing sugars in the tobacco without substantially reducing moisture content of the tobacco to improve the tobacco flavor compounds; cooling the tobacco in the containing zone to a lower preselected temperature level; and removing the treated tobacco from the containing zone.

2. The method of claim 1, said tobacco having a moisture content of at least 10% by weight when introduced into said containing zone.

3. The method of claim 1, and reordering said treated tobacco to a moisture content of 12% to 15% by weight.

4. The method of claim 1, said tobacco having a moisture content in the range of approximately 10%–60% by weight when introduced into said containing zone.

5. The method of claim 1, said tobacco having a moisture content advantageously in the range of approximately 14%–21% by weight when introduced into said containing zone.

6. The method of claim 1, said tobacco being subjected to at least fifteen inches of mercury vacuum when in said containing zone prior to introduction of an ammonia source into said zone.

7. The method of claim 1, said ammonia source introduced into said containing zone as an ammonia gas.

8. The method of claim 1, said ammonia source being introduced into said containing zone by pretreating the tobacco with ammonium hydroxide.

9. The method of claim 1, said heating of said containing zone being accomplished by injecting superheated steam into said containing zone when substantially closed.

10. The method of claim 1, said temperature range of said tobacco in said containing zone being maintained preferably in the range of approximately 280° to 320° F. when substantially closed.

11. The method of claim 1, said tobacco temperature in said containing zone being maintained advantageously at approximately 308° F.

12. The method of claim 1, said temperature range of approximately 250° F. to 350° F. being maintained for a time period in the range of approximately 5 minutes to 24 hours.

13. The method of claim 1, said heating of said containing zone being accomplished by an injection of steam for approximately twenty minutes at a temperature of approximately 308° F. when said zone is substantially closed.

14. The method of claim 1, comprising heating said containing zone with steam for ninety minutes at a temperature of approximately 308° F. when said zone is closed.

15. The method of claim 1, said tobacco being cooled in said containing zone by releasing the gas pressure in said containing zone.

16. The method of claim 1, said tobacco being cooled in said containing zone by subjecting the containing zone to conductive cooling.

17. The method of claim 1, said tobacco being cooled in said containing zone by allowing the heat in said tobacco to be reduced to ambient by natural convection.

18. The method of claim 1, said ammonia source and said heat being introduced to the said containing zone simultaneously.

19. The method of claim 1, said ammonia source and said heat being introduced to the said containing zone sequentially.

20. The method of claim 1, said tobacco being a mixture of stem and leaf tobacco in preselected proportions.

21. The method of claim 1, said tobacco being reconstituted tobacco.

22. The method of claim 1, said tobacco being substantially of stem type.

23. The method of claim 1, said tobacco being substantially of leaf type.

24. The method of claim 1, said heating of said containing zone being controlled to bring the pressure in said zone when substantially closed within an approximate range of at least 30 psig to 90 psig.

25. The method of claim 1, said heating of said containing zone being controlled to bring the pressure in said zone when substantially closed to advantageously 60 psig.

26. The method of claim 1, including the step of adding reducing sugars.

27. The method of claim 1, including the step of adding reducing sugars comprising approximately 20% of the tobacco weight.

28. A process of forming favorable flavor compounds in a moisturized tobacco comprising: introducing tobacco having a moisture content in the range of approximately 14–21% by weight into a tobacco containing zone; subjecting said tobacco in said containing zone to at least fifteen inches of mercury vacuum when in said containing zone; introducing an ammonia source into said tobacco containing zone; injecting superheated steam into said containing zone when substantially closed to bring the temperature of the tobacco introduced into said zone to a temperature of approximately 308° F. and to a pressure of approximately 60 psig of a period of approximately twenty minutes to cause reaction of the ammonia source and reducing sugars in the tobacco without substantially reducing moisture content of the tobacco to improve tobacco flavor compounds; cooling said tobacco in said containing zone by allowing the heat in said tobacco to be reduced to ambient by natural convection; removing the treated tobacco from the said containing zone; and reordering said treated tobacco to a moisture content of 12% to 15% by weight.

29. A process of forming favorable flavor compounds in a moisturized tobacco comprising: introducing tobacco having a moisture content in the range of approximately 14–21% by weight into a tobacco containing zone; introducing an ammonia source into said tobacco containing zone; indirectly heating said tobacco while in said containing zone when substantially closed to bring the temperature of the tobacco introduced into said zone to a temperature of approximately 308° F. and to a pressure of approximately 60 psig for a period of approximately ninety minutes to cause reaction of the ammonia source and reducing sugars in the tobacco without substantially reducing moisture content of the tobacco to improve tobacco flavor compounds; cooling said tobacco in said containing zone by allowing the heat in said tobacco to be reduced to ambient by natural convection; removing the treated tobacco from the said containing zone; and reordering said treated tobacco to a moisture content of 12% to 15% by weight.

* * * * *

UNITED STATES PATENT AND TRADEMARK OFFICE

CERTIFICATE OF CORRECTION

PATENT NO. : 4,744,375
DATED : May 17, 1988
INVENTOR(S) : Robert F. Denier, et al It is certified that error appears in the above—identified patent and that said Letters Patent is hereby corrected as shown below:

Claim 27, column 12, line 25, the phrase "method of claim 1" should be changed to ---method of claim 26---.

Signed and Sealed this

Twenty-first Day of February, 1989

*Attest:*

DONALD J. QUIGG

*Attesting Officer*

*Commissioner of Patents and Trademarks*